US009389561B2

(12) United States Patent
Kobayashi et al.

(10) Patent No.: US 9,389,561 B2
(45) Date of Patent: Jul. 12, 2016

(54) IMAGE FORMING APPARATUS UTILIZING A PLURALITY OF IMAGE FORMATION VELOCITIES

(71) Applicants: Kazuhiro Kobayashi, Kanagawa (JP); Toshiyuki Uchida, Kanagawa (JP); Kaoru Yoshino, Tokyo (JP); Toshihiro Shimada, Tokyo (JP)

(72) Inventors: Kazuhiro Kobayashi, Kanagawa (JP); Toshiyuki Uchida, Kanagawa (JP); Kaoru Yoshino, Tokyo (JP); Toshihiro Shimada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/867,452

(22) Filed: Sep. 28, 2015

(65) Prior Publication Data

US 2016/0098005 A1 Apr. 7, 2016

(30) Foreign Application Priority Data

Oct. 1, 2014 (JP) ..... 2014-203300

(51) Int. Cl.
*G03G 15/01* (2006.01)
*G03G 15/36* (2006.01)

(52) U.S. Cl.
CPC ..... *G03G 15/36* (2013.01); *G03G 15/0131* (2013.01)

(58) Field of Classification Search
CPC ..... G03G 15/36; G03G 15/0131
USPC ..... 399/301
See application file for complete search history.

(56) References Cited

U.S. PATENT DOCUMENTS

2006/0222418 A1 10/2006 Ebara et al.
2008/0166153 A1 7/2008 Ehara et al.
2011/0052275 A1* 3/2011 Matsumoto ..... G03G 15/0131 399/301
2011/0085187 A1* 4/2011 Lee ..... G03G 15/0131 358/1.9
2015/0147099 A1 5/2015 Tosaka et al.

FOREIGN PATENT DOCUMENTS

JP 2001-272837 10/2001
JP 2003-233233 8/2003
JP 2009-288376 A 12/2009

OTHER PUBLICATIONS

U.S. Appl. No. 14/732,127, filed Jun. 5, 2015, Akihiko Tosaka, et al.

* cited by examiner

*Primary Examiner* — Susan Lee
(74) *Attorney, Agent, or Firm* — Oblon, McClelland, Maier & Neustadt, L.L.P

(57) ABSTRACT

An image forming apparatus includes a plurality of latent image bearers, a latent image writer, a plurality of developing units, a primary transfer unit, a secondary transfer unit, an adjuster, a pattern image formation controller, a color deviation detector, a color deviation correction controller, and an image-formation-mode setting unit. The color deviation correction controller executes color deviation correction control in the separated state. The image-formation-mode setting unit sets a normal linear-velocity image formation mode in which an image is formed at a normal linear velocity and at least one non-normal linear-velocity image formation mode including a low linear-velocity image formation mode in which an image is formed at a low linear velocity slower than the normal linear velocity. A plurality of image formation velocities including the normal linear velocity and the low linear velocity is set, and an execution timing of the color deviation correction control in image formation at the normal linear velocity and an execution timing of the color deviation correction control in image formation at the low linear velocity are set independently from each other.

8 Claims, 9 Drawing Sheets

IMAGE FORMING APPARATUS UTILIZING A PLURALITY OF IMAGE FORMATION VELOCITIES

CROSS-REFERENCE TO RELATED APPLICATIONS

This patent application is based on and claims priority pursuant to 35 U.S.C. §119(a) to Japanese Patent Application No. 2014-203300, filed on Oct. 1, 2014, in the Japan Patent Office, the entire disclosure of which is hereby incorporated by reference herein.

BACKGROUND

1. Technical Field

Embodiments of this disclosure relate to an image forming apparatus.

2. Description of the Related Art

Recently, an image forming apparatus of a tandem system such as a color copier and a color printer to transfer toner images formed on a plurality of photoconductors to a surface of an intermediate transferer such as a belt to be superimposed is mainly used. As a color deviation correction control method in the image forming apparatus of the tandem system, the following method is generally taken. That is, a test pattern image for color deviation detection of each color is formed on an intermediate transfer belt to be the intermediate transferer, a position of the test pattern image is detected by a sensor, and a color deviation amount of each component (registration, magnification, skew, and the like) is calculated from a detection result. In addition, an optical path of each optical system is corrected or an image writing position or a pixel clock frequency of each color is corrected on the basis of a calculation result.

Further, technology for correcting a color deviation during print by forming a pattern for color deviation detection outside an image area of the intermediate transfer belt during a plain paper job to decrease downtime of a user is known.

SUMMARY

In an aspect of the present disclosure, there is provided an image forming apparatus that includes a plurality of latent image bearers, a latent image writer, a plurality of developing units, a primary transfer unit, a secondary transfer unit, an adjuster, a pattern image formation controller, a color deviation detector, a color deviation correction controller, and an image-formation-mode setting unit. The latent image writer writes latent images to the latent image bearers. The plurality of developing units develops the latent images of the latent image bearers and form toner images of different colors. The primary transfer unit transfers the toner images on the latent image bearers to an intermediate transferer. The secondary transfer unit transfers the toner images from the intermediate transferer to a sheet. The adjuster causes the intermediate transferer and the secondary transfer unit to be in a contact state or a separated state. The pattern image formation controller forms a pattern image on the intermediate transferer via the latent image bearers to detect color deviation. The color deviation detector detects the color deviation of the pattern image borne on the intermediate transferer. The color deviation correction controller executes color deviation correction control in the separated state. The image-formation-mode setting unit sets a normal linear-velocity image formation mode in which an image is formed at a normal linear velocity and at least one non-normal linear-velocity image formation mode including a low linear-velocity image formation mode in which an image is formed at a low linear velocity slower than the normal linear velocity. A plurality of image formation velocities including the normal linear velocity and the low linear velocity is set, and an execution timing of the color deviation correction control in image formation at the normal linear velocity and an execution timing of the color deviation correction control in image formation at the low linear velocity are set independently from each other.

In an aspect of the present disclosure, there is provided an image forming apparatus includes a plurality of latent image bearers, a latent image writer, a plurality of developing units, a primary transfer unit, a secondary transfer unit, an adjuster, a pattern image formation controller, a color deviation detector, a color deviation correction controller, an image-formation-mode setting unit, a single image formation page number counter, a sheet-count threshold setter, and an adder. The latent image writer writes latent images to the latent image bearers. The plurality of developing units develops the latent images of the latent image bearers and form toner images of different colors. The primary transfer unit transfers the toner images on the latent image bearers to an intermediate transferer. The secondary transfer unit transfers the toner images from the intermediate transferer to a sheet. The adjuster causes the intermediate transferer and the secondary transfer unit to be in a contact state or a separated state. The pattern image formation controller forms a pattern image to detect color deviation on the latent image bearers. The color deviation detector detects the color deviation of the pattern image borne on the intermediate transferer. The color deviation correction controller executes color deviation correction control in the separated state. The image-formation-mode setting unit sets a normal linear-velocity image formation mode in which an image is formed at a normal linear velocity, a moderate linear-velocity image formation mode in which an image is formed at a moderate linear velocity slower than the normal linear velocity, and a low linear-velocity image formation mode in which an image is formed at a low linear velocity slower than the moderate linear velocity. The single image formation page number counter counts a number of sheets on which images are formed. The sheet-count threshold setter sets a correction execution page number threshold value relating to the number of sheets as a threshold value to execute the color deviation correction control. The adder adds a number of sheets changed for each of the normal linear-velocity image formation mode, the moderate linear-velocity image formation mode, and the low linear-velocity image formation mode to the number of sheets counted by the image formation page number counter. A plurality of image formation velocities including the normal linear velocity, the moderate linear velocity, and the low linear velocity is set, and an execution timing of the color deviation correction control is when the number of sheets for each of the normal linear-velocity image formation mode, the moderate linear-velocity image formation mode, and the low linear-velocity image formation mode added by the adder exceeds the correction execution page number threshold value.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
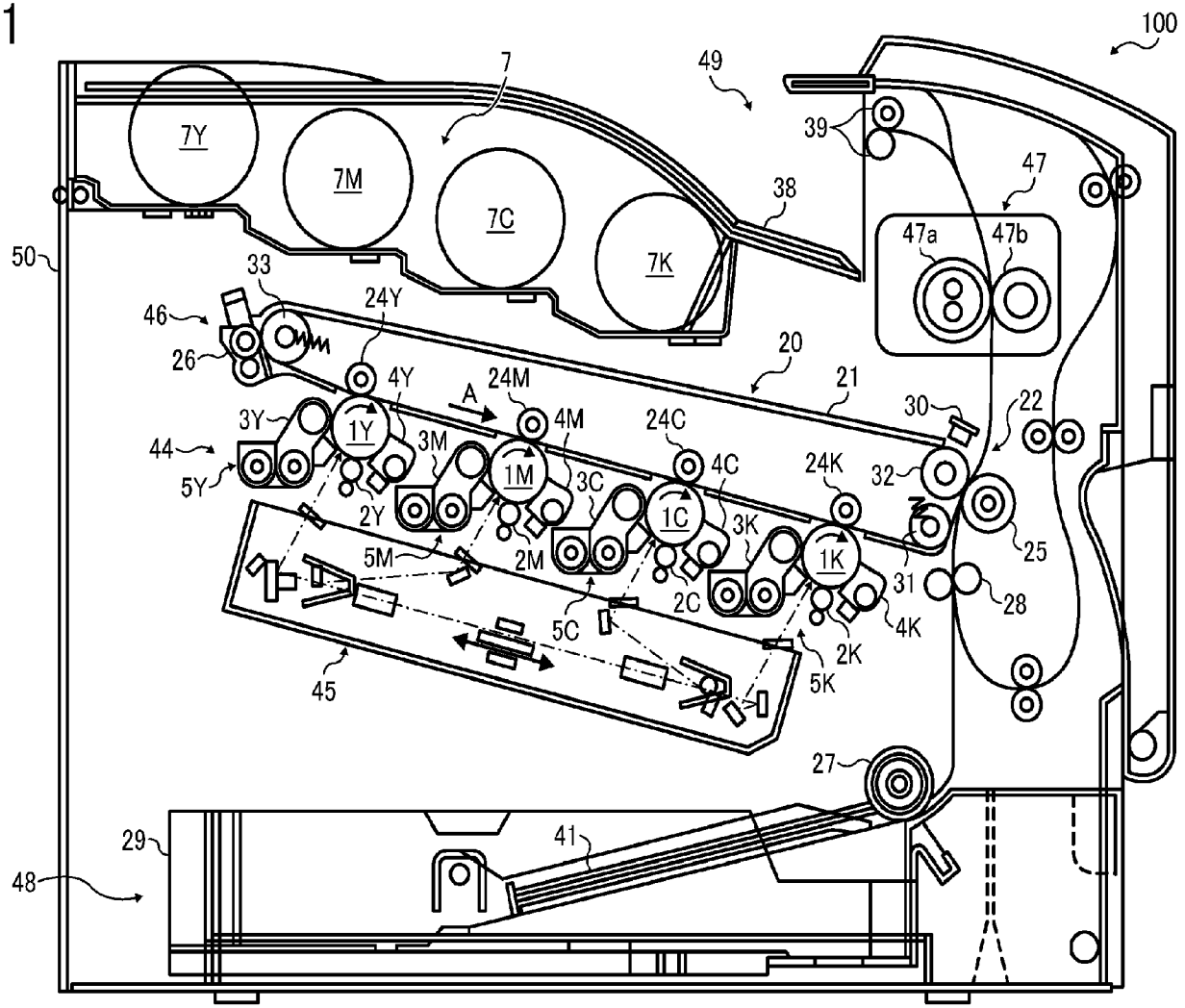
FIG. 1 is a schematic view of an entire configuration of an image forming apparatus according to an embodiment to which the present disclosure is applied.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

As a color deviation correction control method in an image forming apparatus of a tandem system, technology for correcting a color deviation during print by forming a pattern for color deviation detection outside an image area of an intermediate transfer belt during a plain paper job is known. The technology relates to color deviation correction in a low velocity mode (hereinafter, referred to as a "low-velocity print mode") executed by low-velocity print executed under a condition where a velocity is slower than a normal linear velocity in a normal linear-velocity mode executed at a normal image formation velocity or a normal print speed (hereinafter, referred to as the "normal linear velocity"). Hereinafter, in this specification, terms "image formation" and "print" are used as synonyms.

However, color deviation correction control has been executed under the same setting condition as the normal print speed at the time of the low-velocity print. Here, in the low velocity mode, an image formation velocity becomes slow as compared with image formation at the normal linear velocity. For this reason, when the number of printed pages is set as an execution condition of the color deviation correction control, time is necessary until the print is executed by the set number of printed pages, so that execution timing of the color deviation correction control may is delayed as compared with the case of the normal linear velocity.

In the low velocity mode, a temperature characteristic of a lens in a writing unit may change while the time necessary to execute the print by the set number of printed pages passes. For this reason, color deviation correction precision at the time of the low-velocity print is deteriorated as compared with color deviation correction precision at the time of normal print. As measures to resolve such a problem, it is necessary to take measures to increase an operating amount of a unit cooling fan to be arranged to suppress the temperature characteristic in the writing unit from changing. As a result, consumption power and a cost increase.

According to at least one embodiment of the present disclosure described below, temporal color matching precision when an image is formed at a low linear velocity can be improved.

Referring now to the drawings, embodiments of the present disclosure are described in detail below. In the drawings for explaining the following embodiments, the same reference codes are allocated to elements (members or components) having the same function or shape and redundant descriptions thereof are omitted below.

Referring to FIG. 1, an entire configuration of an image forming apparatus to which the present disclosure is applied will be described. FIG. 1 is a schematic view of the entire configuration of the image forming apparatus to which the present disclosure is applied. In FIG. 1, a color printer 100 is a color printer of a quadruple tandem-type intermediate transfer system to be an example of the image forming apparatus to which the present disclosure is applied. In the color printer 100, a color image is formed from toners of four colors of yellow (Y), magenta (M), cyan (C), and black (K). The color printer 100 includes a toner container 7, an image forming device 44, an exposure device 45, a transfer device 46, a fixing device 47, a sheet feed device 48, a sheet ejection device 49, and a controller in an apparatus body 50.

The toner container 7 is a device to accommodate new toners of the four colors and is arranged on an upper portion of the apparatus body 50. The toner container 7 includes toner bottles 7Y, 7M, 7C, and 7K to accommodate toners of the four colors, respectively, and transports a new toner of a predetermined amount to a developing device to be described below via a toner supply unit or a toner supply passage.

The image forming device 44 includes four process cartridges to form single color images from the toners of the four colors, respectively, and is arranged on an approximately center portion of the apparatus body 50. The image forming device 44 mainly includes four process cartridges 5Y, 5M, 5C, and 5K (to be described below) depending on four photoconductor drums 1Y, 1M, 1C, and 1K functioning as latent image bearers or image bearers corresponding to the toners of the four colors. In the image forming device 44, the single color images are formed from the toners of Y, M, C, and K supplied from the toner bottles 7Y, 7M, 7C, and 7K by the process cartridges 5Y, 5M, 5C, and 5K.

The exposure device 45 functions as a latent image writer to write an electrostatic latent image to each latent image bearer of the image forming device 44 and is arranged below the image forming device 44. The exposure device 45 has a laser light source such as a laser diode (LD), a polygon motor functioning as a writing motor, and an image writing mirror. In the exposure device 45, the laser light source irradiates the photoconductor drums 1Y, 1M, 1C, and 1K with laser light, scanning is performed by the polygon motor, and surfaces of the photoconductor drums 1Y, 1M, 1C, and 1K charged uniformly by a charger to be described below are exposed. In addition, a surface potential is partially decreased and an electrostatic latent image is formed.

The transfer device 46 is a device to finally transfer a toner image formed by the image forming device 44 to a recording sheet functioning as a recording medium and is arranged above the image forming device 44. The transfer device 46 has an intermediate transfer belt 21, three driven rollers 31, a drive roller 32, a driven roller 33, four primary transfer rollers 24Y, 24C, 24M, and 24K, and a secondary transfer roller 25. An intermediate transfer unit 20 has a configuration obtained by excluding the secondary transfer roller 25 from the transfer device 46.

The intermediate transfer belt 21 has a function as an intermediate transferer, has an endless belt shape, and is formed of a semi-conductive elastic resin. The intermediate transfer belt 21 is wound on the driven roller 31, the drive roller 32, and the driven roller 33 to be three rotary supporters and is supported by means of tension. The drive roller 32 is connected to a drive motor via a drive transmitter such as a gear train. When an image is formed, the drive roller 32 is rotated by the drive motor in a counterclockwise direction, so that the intermediate transfer belt 21 travels in a movement direction indicated by arrow A in FIG. 1 (hereinafter, movement direction A) and is rotated.

The primary transfer rollers 24Y, 24C, 24M, and 24K function as primary transfer units to primarily transfer the toner images formed on the photoconductor drums 1Y, 1M, 1C, and 1K to the intermediate transfer belt 21. The primary transfer rollers 24Y, 24C, 24M, and 24K are arranged to face the photoconductor drums 1Y, 1M, 1C, and 1K with the intermediate transfer belt 21 therebetween, are driven by rotation of the intermediate transfer belt 21 in the movement direction A, and rotate. An intermediate-transfer-belt cleaning device 26 is provided to face the driven roller 33 with the intermediate transfer belt 21 therebetween.

The primary transfer rollers 24Y, 24C, 24M, and 24K are pressed from the inside of the intermediate transfer belt 21 to the photoconductor drums 1Y, 1M, 1C, and 1K by an adjustment assembly and form primary transfer nips. Each of the primary transfer rollers 24Y, 24C, 24M, and 24K is a transfer bias (transfer voltage) applicator of a contact type connected to a bias power supply and a primary transfer bias having the polarity opposite to the polarity of the toner image is applied from a back surface of the intermediate transfer belt 21. As the transfer bias applicator, a transfer bias applicator of a non-contact type using a transfer charger may be used. However, in this color printer 100, the primary transfer rollers in which occurrence of transfer dust particles is small are adopted. By a configuration using the primary transfer rollers, an assembly to contact the primary transfer rollers with the intermediate transfer belt softly may be used, instead of the adjustment assembly to press the primary transfer rollers to the intermediate transfer belt, as described above.

The secondary transfer roller 25 is arranged to face the drive roller 32 with the intermediate transfer belt 21 therebetween. A secondary transfer device 22 includes the intermediate transfer belt 21, the secondary transfer roller 25, and the drive roller 32. The secondary transfer roller 25 is configured such that a shaft of the secondary transfer roller 25 is pressed against the drive roller 32 by a biasing member such as a spring of an adjuster with the intermediate transfer belt 21 therebetween to form a secondary transfer nip. The secondary transfer roller 25 is connected to a bias power supply and becomes a transfer bias applicator of a contact type to apply a secondary transfer bias having the polarity opposite to the polarity of the toner image. The drive roller 32 may become the transfer bias applicator. In this case, a transfer bias having the same polarity as the polarity of a toner image to be transferred is applied.

The adjuster contacts the secondary transfer roller 25 with the drive roller 32 with the intermediate transfer belt 21 therebetween or separates the secondary transfer roller 25 from the drive roller 32. As the adjuster, a variety of known adjustment assemblies may be used. An optical sensor 30 to detect a position of a test pattern for color deviation detection of each color formed on the intermediate transfer belt 21 is arranged on the intermediate transfer belt 21 in the vicinity of the drive roller 32.

The intermediate-transfer-belt cleaning device 26 is a cleaner that scrapes a residual toner adhered to an outer circumferential surface of the intermediate transfer belt 21 by a brush roller and a cleaning blade while applying a lubricant by the brush roller and collects the residual toner. The collected residual toner is transported from the intermediate-transfer-belt cleaning device 26 to a waste toner tank by a transport unit and is scrapped.

The fixing device 47 is a device to fix the toner image transferred by the transfer device 46 on a recording sheet and is arranged above the transfer device 46. The fixing device 47 has a fixing roller 47*a* having a heater to be a heat generator therein and a pressure roller 47*b*. The pressure roller 47*b* is pressed by a biasing member and is pressed against the fixing roller 47*a*, so that a fixing nip is formed. In the fixing nip, a heat by the fixing roller 47*a* and a pressure by the pressure roller 47*b* are applied to the recording sheet conveyed from the sheet feed device 48 to be described below, so that a non-fixed toner image transferred to the recording sheet by the transfer device 46 is fixed on the recording sheet.

The sheet feed device 48 is a device to feed a recording sheet 41 (is not limited to paper and may be any material having a sheet shape) of a predetermined size such as copier paper and a resin sheet (for example, an OHP sheet) to the transfer device 46 and is arranged on a lowermost portion of the apparatus body 50. The sheet feed device 48 includes a sheet feed tray 29 to accommodate and stock the recording sheet 41, a sheet feed roller 27 to feed each recording sheet 41 to a conveyance passage, and a registration roller pair 28 to adjust timing when the recording sheet 41 is conveyed to the secondary transfer nip. The sheet feed roller 27 is pressed against the recording sheet 41 stocked in the sheet feed tray 29 by a predetermined pressure and feeds each recording sheet 41 to the conveyance passage, on the basis of a control signal from a controller.

The sheet ejection device 49 is a device to stack the recording sheet 41 on which an image has been fixed by the fixing device 47 and is formed on a top surface of the apparatus body 50. The sheet ejection device 49 includes a sheet ejection tray 38 to be formed on the top surface of the apparatus body 50 and a sheet ejection roller pair 39 to eject the recording sheet 41 having passed through the fixing device 47 to the sheet ejection tray 38.

A process cartridge of the color printer 100 will be described. As described above, the color printer 100 includes the four process cartridges 5Y, 5M, 5C, and 5K to be image forming units formed in order of yellow, magenta, cyan, and black from the movement direction upstream side along a bottom surface of the intermediate transfer belt 21. Because these process cartridges 5Y, 5M, 5C, and 5K have almost the same configuration, the process cartridge 5Y for yellow arranged on (located at) the uppermost stream side will be described as an example.

The process cartridge 5Y is provided in a cartridge body to be removably attached relative to the apparatus body 50 and replaces a consumable component at a time. The process cartridge 5Y mainly includes a charging device 2Y functioning as a charger, a developing device 3Y functioning as a developing unit, and a cleaning device 4Y functioning as a cleaner, which are arranged sequentially from the upstream side of the rotation direction of the photoconductor drum 1Y.

The charging device 2Y has a function of charging an outer circumferential surface of the photoconductor drum 1Y uniformly with the predetermined polarity and includes a charging roller functioning as a charger that is arranged in the vicinity of the photoconductor drum 1Y and charges the outer circumferential surface of the photoconductor drum 1Y uniformly with the predetermined polarity.

The developing device 3Y has a function of making an electrostatic latent image born by the photoconductor drum 1Y visible as a toner image by a toner of a yellow color. The developing device 3Y is a developing device of a two-component development system of a dual-axis conveyance type and adheres the toner of a powdery two-component developer including the toner and the carrier to an electrostatic latent image portion of the photoconductor drum 1Y by the developing roller.

The cleaning device 4Y has a function of cleaning the residual toner on the photoconductor drum 1Y after the primary transfer. The cleaning device 4Y includes a cleaning blade that contacts the photoconductor drum 1Y and scrapes a primary residual toner adhered to the outer circumferential surface of the photoconductor drum 1Y after the primary transfer for cleaning. Further, the cleaning device 4Y includes a cleaning case to accommodate the scraped residual toner and a toner transport screw to transport the residual toner in the cleaning case to the waste toner tank.

An image formation operation of the process cartridge will be described. First, the outer circumferential surface of the photoconductor drum 1Y is charged uniformly with the predetermined polarity by the charging roller of the charging device 2Y. In an area of the downstream side of the rotation direction of the photoconductor drum 1Y in the charging device 2Y, the exposure device 45 emits laser light shown by a one-dot chain line, on the basis of image data, the surface potential of the photoconductor drum 1Y charged uniformly is decreased by an emission portion, and an electrostatic latent image is formed. In addition, the toner of the yellow color is supplied to the electrostatic latent image to make the electrostatic latent image visible as a toner image by the developing device 3Y. A yellow single color image moves to the primary transfer nip according to the rotation of the photoconductor drum 1Y, the primary transfer bias is applied from the primary transfer roller 24Y to the yellow single color image, and the yellow single color image is transferred to the intermediate transfer belt 21 using electrostatic attractive force. Then, the primary residual toner adhered to the outer circumferential surface of the photoconductor drum 1Y after the primary transfer is cleaned by the cleaning device 4Y for next image formation.

Next, an image formation operation of the color printer 100 will be described. First, as described above, in the process cartridge 5Y, the yellow single color image is formed on the photoconductor drum 1Y. Next, the photoconductor drum 1Y is rotated to the primary transfer nip, the primary transfer bias having the polarity opposite to the polarity of the toner is applied to the yellow single color image by the primary transfer roller 24Y, and the yellow single color image is transferred to the intermediate transfer belt 21 by the electrostatic attractive force. Similarly to the process cartridge 5Y, in the other process cartridges 5M, 5C, and 5K, a single color image is formed and the primary transfer is executed in order of yellow, magenta, cyan, and black according to rotation timing of the intermediate transfer belt 21. In this way, yellow, magenta, cyan, and black toner images are superimposed on the intermediate transfer belt 21 and a full-color toner image is formed.

Meanwhile, in the sheet feed device 48, each recording sheet 41 is fed from the sheet feed tray 29 by the sheet feed roller 27. If the recording sheet 41 arrives at the registration roller pair 28, this is detected by a sheet edge sensor, timing of the secondary transfer is adjusted by the registration roller pair 28 on the basis of a detection signal, and the recording sheet is fed to the secondary transfer nip. Therefore, the secondary transfer bias is applied to the recording sheet 41 by the secondary transfer roller 25 and a full-color toner image on the intermediate transfer belt 21 is transferred collectively to the recording sheet 41 by the electrostatic attractive force. Next, the recording sheet 41 bearing a non-fixed toner image on a surface thereof is fed to the fixing nip of the fixing device 47, the heat and the pressure are applied to the recording sheet 41, and the non-fixed toner image is fixed on the recording sheet 41. As such, after the image is fixed on the recording sheet 41, the recording sheet 41 is ejected to the sheet ejection tray 38 by the sheet ejection roller pair 39 of the sheet ejection device 49 and is stacked. In addition, the residual toner adhered to the surface of the intermediate transfer belt 21 after the secondary transfer is removed by the intermediate-transfer-belt cleaning device 26 for a next image formation operation. In addition, the residual toner removed by the intermediate-transfer-belt cleaning device 26 is transported to the waste toner tank and is scrapped.

First Embodiment

Figure 2A:
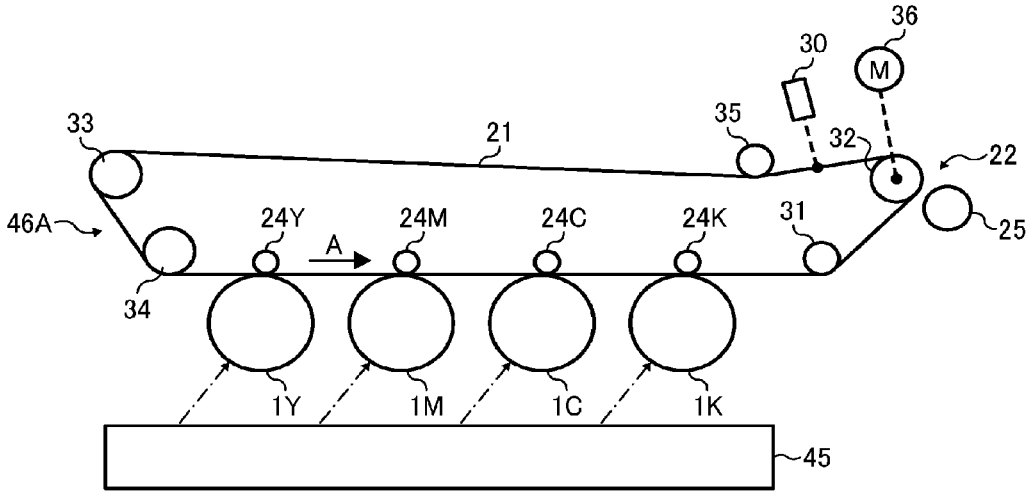
FIG. 2A is a schematic front view of a separated state of a secondary transfer device illustrating a peripheral configuration of a transfer device of an image forming apparatus according to a first embodiment.
Figure 2B:
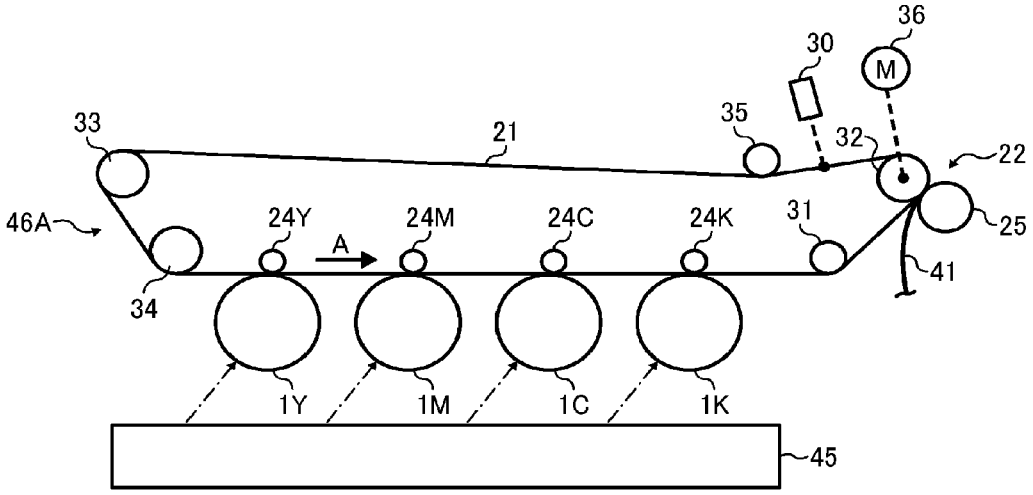
FIG. 2B is a schematic front view of a contact state of the secondary transfer device illustrating the peripheral configuration of the transfer device of the image forming apparatus according to the first embodiment.
Figure 3:
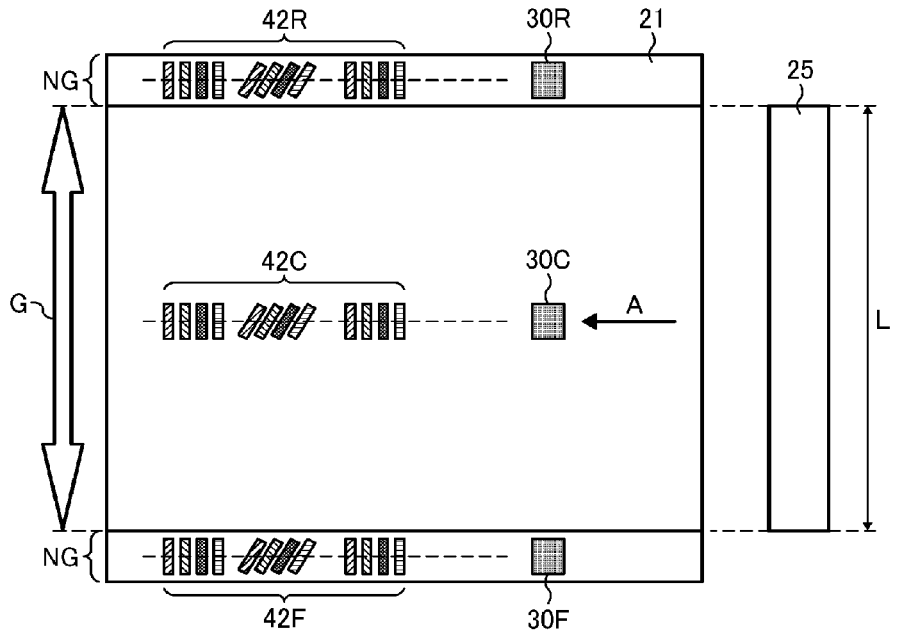
FIG. 3 is a plan view of an arrangement state of a color deviation detection pattern and an optical sensor used for color deviation correction in the separated state of the secondary transfer device according to the first embodiment.
Figure 4:
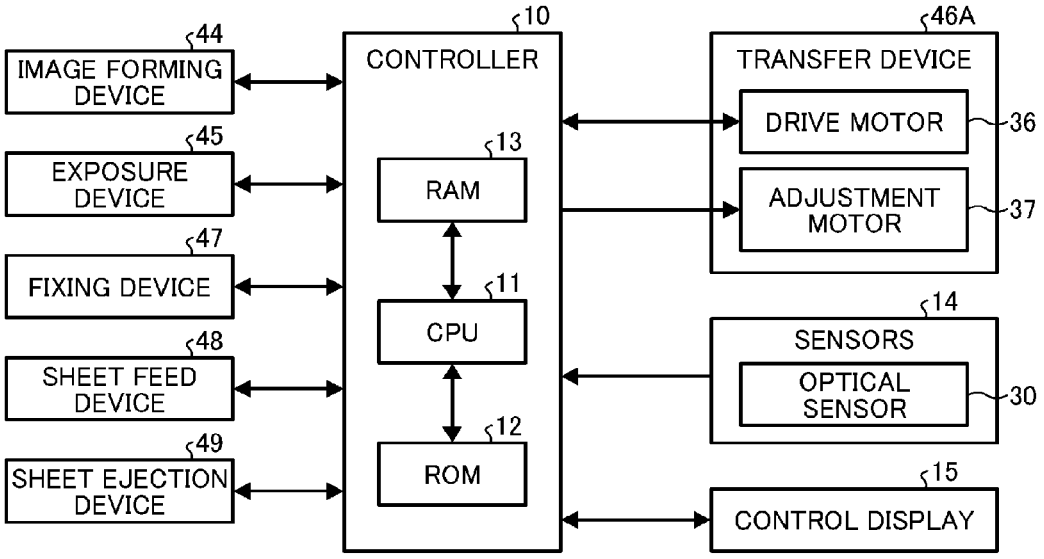
FIG. 4 is a control block diagram of a control configuration according to the first embodiment.

A first embodiment will be described using FIGS. 2A to 4. FIG. 2A is a schematic front view of a separated state of a secondary transfer device illustrating a peripheral configuration of a transfer device of an image forming apparatus according to the first embodiment. FIG. 2B is a schematic front view of a contact state of the secondary transfer device. FIG. 3 is a plan view of an arrangement state of a color deviation detection pattern and an optical sensor used for color deviation correction in the separated state of the secondary transfer device. FIG. 4 is a control block diagram of a control configuration according to the first embodiment.

In the image forming apparatus such as the color printer 100 of the tandem system described above, there is an advantage in that productivity (the number of printable pages per unit time) is greatly improved. However, a color deviation by a position deviation of each color on the recording sheet 41 occurs due to a deviation of position precision or a diameter of the photoconductor drum 1 or the exposure device 45 and a precision deviation of an optical system in the image forming device of each color. For this reason, color deviation control is inevitable.

As a color deviation control method, a method of forming a test pattern image as a pattern image to detect a color deviation of each color on the intermediate transfer belt, detecting a position of the test pattern image by an optical sensor, and calculating a color deviation amount of each component form a detection result is generally known. In this embodiment, a color deviation control method almost equal to the color deviation control method is used and when the test pattern image is detected, the optical sensor 30 is configured from an optical sensor of a light reflection type and strengths of reflection light from a surface of the intermediate transfer belt 21 and a mark of each color are detected. Specific content of color deviation correction control in this embodiment will be described later.

In addition, a skew for black (K), main and sub registration deviations, and a main scanning magnification error are calculated on the basis of the detection result. Various deviation amounts and correction amounts are calculated by a correction amount calculator (controller 10 illustrated in FIG. 4) functioning as a controller and execution of the correction is commanded by the correction amount calculator. Main and sub registrations can be electrically corrected by adjusting writing timing in the exposure device 45 and main scanning magnification can be electrically corrected by adjusting a pixel clock. Meanwhile, as a correction method for a skew of a scanning beam in the exposure device 45, a method of mechanically correcting the skew and a method of deforming an output image in an opposite direction by an image process, outputting the output image, and correcting the skew are known. In the method of mechanically correcting the skew, the correction is realized by providing a moving assembly to move an internal mirror of a writing unit in the exposure device 45. In the method of correcting the skew by the image process, the skew between the individual colors is corrected by storing a part of images in a line memory and reading an image while changing a reading position.

The image forming apparatus according to the first embodiment is different from the color printer 100 illustrated in FIG. 1 in that a transfer device 46A illustrated in FIGS. 2A and 2B and 4 is used, instead of the transfer device 46, and a controller 10 illustrated in FIG. 4 is provided to execute control to change execution timing of color deviation correction control according to a print speed. The image forming apparatus according to the first embodiment is the same as the color printer 100 to be the image forming apparatus illustrated in FIG. 1, except for the difference.

The transfer device 46A is different from the transfer device 46 in that a driven roller 34 and a tension roller 35 are additionally provided and a drive motor 36 to drive a drive roller 32 is clearly displayed, as illustrated in FIGS. 2A and 2B. The drive roller 32 is connected to a general brushless DC motor to be the drive motor 36 functioning as a drive source via a drive transmitter such as a gear train.

Similarly to the conventional general secondary transfer device, in this embodiment, a secondary transfer roller 25 and the drive roller 32 become a roller pair made of rubber (an elastic body) in consideration of transfer for the recording sheet, in a secondary transfer device 22. The drive roller 32 is rotated by the drive motor 36. An adjustment assembly functioning as an adjuster is provided such that the secondary transfer roller 25 and the drive roller 32 becoming the roller pair made of the rubber takes a separated state illustrated in FIG. 2A and a contact state illustrated in FIG. 2B.

Figure 5:
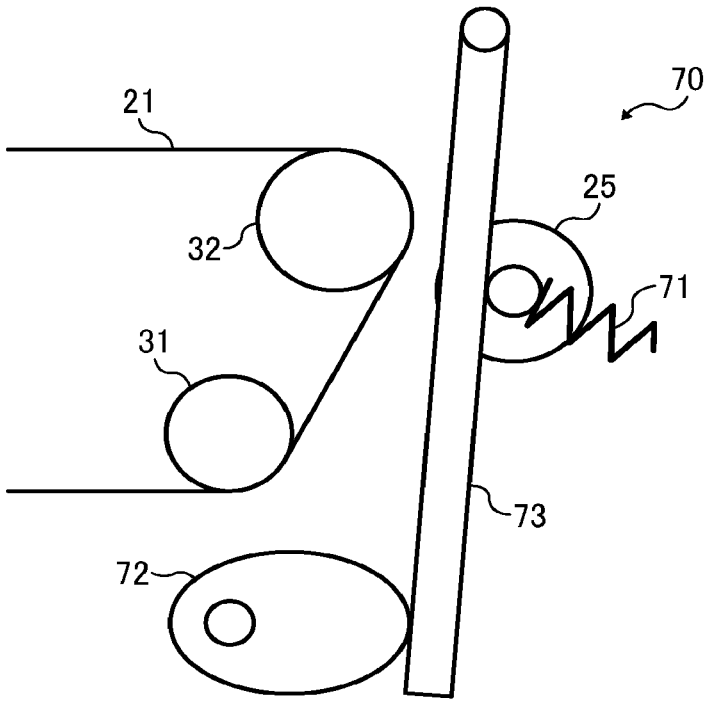
FIG. 5 is a schematic view of an adjustment assembly.

As the adjuster to contact the secondary transfer roller 25 with the drive roller 32 with the intermediate transfer belt 21 therebetween or separate the secondary transfer roller 25 from the drive roller 32, for example, as illustrated in FIG. 5, an adjustment assembly 70 is used that includes a pressing unit such as a spring 71, a cam 72, and an adjustment lever 73. As illustrated in FIG. 4, an adjustment motor 37 is exemplified as a driver to drive the cam of the adjustment assembly. In the contact state, generally, the secondary transfer roller 25 is contacted with the drive roller 32 of the intermediate transfer belt 21 by the pressure of the spring to secure transfer when a toner image transferred to the intermediate transfer belt 21 is secondarily transferred to the recording sheet 41, when the toner image is transferred to the recording sheet 41.

The reason why the separated state illustrated in FIG. 2A is set is as follows. That is, a detection pattern 42C corresponding to a test pattern image illustrated in FIG. 3 is in an image area G in the contact state, the detection pattern 42C is scraped by the secondary transfer roller 25 in the secondary transfer device 22 or a toner image of the detection pattern 42C is adhered to the secondary transfer roller 25. If this phenomenon occurs, an error occurs in detection of the detection pattern 42C by the optical sensor 30 or the toner adhered to the secondary transfer roller 25 is imprinted on a back surface of the recording sheet 41 when the toner image is transferred to the recording sheet 41 thereafter and stains occur. In addition, as illustrated in FIG. 2B, if the contact state is maintained continuously, the surface of the roller pair is deformed by the contact by the pressure of the spring, which may result in leading to speed irregularity of the intermediate transfer belt 21. The color deviation correction control in this embodiment is executed in the separated state of the intermediate transfer belt 21 and the secondary transfer roller 25, in consideration of prevention of the toner stains in the secondary transfer roller 25 and an influence of blurring of the detection pattern 42C, as described above.

In this embodiment, the optical sensor 30 to detect a position of a test pattern (hereinafter, referred to as a "detection pattern") for color deviation detection of each color (to be described below) born on the intermediate transfer belt 21 is arranged on the intermediate transfer belt 21 in the vicinity of the drive roller 32. The optical sensor 30 functions as a color deviation detector to detect a color deviation of a toner image (pattern image) born on the intermediate transfer belt 21. In detail, as illustrated in FIG. 3, optical sensors 30F, 30C, and 30R to read detection patterns 42F, 42C, and 42R of three places, respectively, are arranged. The detection patterns 42F, 42C, and 42R are transferred to the intermediate transfer belt 21, so that correction precision is improved. The optical sensor 30 in this embodiment is a general term of the optical sensors 30F, 30C, and 30R arranged in the three places. Hereinafter, detection of the detection pattern is simply called "pattern detection". Here, a main scanning direction is a rotation axis direction (longitudinal direction) of the photoconductor drum 1 and a sub-scanning direction is a rotation direction of the photoconductor drum 1.

A control configuration according to this embodiment will be described using FIG. 4. FIG. 4 is a control block diagram of the control configuration according to this embodiment. The color printer 100 according to this embodiment includes the controller 10 functioning as a controller to execute entire control of the color printer. The controller 10 includes a central processing unit (CPU) 11 having functions of a calculator and a controller and a data storage device. The data storage device includes a random access memory (RAM) including a non-volatile memory such as a flash memory to store data, a read only memory (ROM) including a non-volatile memory such as an electrically erasable programmable read only memory (EEPROM), and a hard disk drive (HDD). The EEPROM is a non-volatile memory that can hold data, even though a power supply is turned off. In this embodiment, the data storage device includes a ROM 12 in which a system OS, copies, facsimiles, various control programs necessary for a printer process, a page description language (PDL) process system of the printer, and an initial setting value of the system are stored and a RAM 13 for a work memory.

The CPU 11 controls a driver of each device of the color printer 100 and a liquid crystal display of a control display 15 via the data storage device, on the basis of various signals from various sensors 14 arranged in the color printer 100 and signals set by various keys of the control display 15. As a representative sensor of the various sensors 14, the optical sensor 30 is exemplified. As the driver of each device, a driver such as a motor or a solenoid of an image forming device 44, an exposure device 45 to be a writing unit, a drive motor 36 and an adjustment motor 37 of an adjustment assembly of a transfer device 46A, a fixing device 47, a sheet feed device 48, and a sheet ejection device 49, illustrated in FIG. 4, is exemplified.

Data of the various sensors and counter data such as the number of printed pages by internal management of the CPU 11 are stored regularly in the RAM 13 including the non-volatile memory and the ROM 12 including the non-volatile memory. Control programs to show functions of a pattern image formation controller, a color deviation correction controller, and the CPU 11 to change execution timing of color deviation correction control, programs illustrated in flowcharts to be described below, and necessary relation data are stored in the ROM 12. In addition, a control program to control each drive motor to execute a print operation according to a plurality of print speeds, that is, a plurality of print modes is stored in the ROM 12. The ROM 12 also functions as an image-formation-mode setting unit to set a normal linear-velocity image formation mode in which an image is formed at a normal linear velocity and at least one non-normal linear-velocity image formation mode including a low linear-velocity image formation mode in which an image is formed at a low linear velocity slower than the normal linear velocity. As described above, the normal linear-velocity image formation mode and the normal linear-velocity print mode are the same mode and the low linear-velocity image formation mode and the low linear-velocity print mode are the same mode. A program to execute each mode is also stored previously in the ROM 12.

As the necessary relation data stored/set in the ROM 12, a correction execution page number threshold value set to each print mode is exemplified. The correction execution page number threshold value set to each print mode can be changed and set to any value desired by a user by setting up a service program by various key settings of the control display 15, for example. At this time, the changed correction execution page number threshold value is stored in the ROM 12 including the EEPROM to be the non-volatile memory.

The CPU 11 according to this embodiment has a function of a pattern image formation controller to form a color deviation detection pattern to detect a color deviation on the intermediate transfer belt 21 via each of the photoconductor drums 1Y, 1M, 1C, and 1K. In addition, the CPU 11 has a function of a color deviation correction controller to execute color deviation correction control in the separated state of the intermediate transfer belt 21 and the secondary transfer roller 25.

In addition, the CPU 11 has a function of a printed page number counter corresponding to a single image formation page number counter to count the number of image formed/printed recording sheets set to each print mode. The printed page number counter of the CPU 11 is the same as a counter normally used by process control by the CPU 11.

In addition, the CPU 11 functions as a timing controller that sets when the number of recording sheets counted by the printed page number counter exceeds the correction execution page number threshold value set to each print mode as color deviation correction control execution timing and executes color deviation correction control.

In the color printer 100 according to this embodiment, print speeds to be a plurality of image formation velocities are set in the same apparatus. As the plurality of print speeds, a normal print speed to execute print at a normal linear velocity, a low print speed to execute print at a low linear velocity slower than the normal linear velocity, and a moderate print speed to execute print at a moderate linear velocity between the normal linear velocity and the low linear velocity are stored/set in the ROM 12.

A normal linear-velocity mode is used to form an image on a recording sheet such as plain paper and a PPC to be normally used. A moderate-velocity print mode and a low-velocity print mode are used to form an image on special paper such as thick paper or an OHP sheet. In the moderate-velocity print mode and the low-velocity print mode, the print speeds are lower than the print speed in the normal linear-velocity mode to secure fixation for the special paper in particular. The moderate-velocity print mode is a mode in which print is executed using the thick paper to be a thick sheet. Generally, in the low-velocity print mode, the print speed is set to about ½ to ⅕ of the print speed in the normal linear-velocity mode. In the color printer 100 according to this embodiment, similarly to a general printer, the normal linear-velocity mode is initially set. When a recording sheet to be used is selected by the key operation of the control display 15, a print mode corresponding to the recording sheet is automatically set. For example, when an image is formed on the thick paper, the moderate-velocity print mode (hereinafter, referred to as a "moderate linear-velocity mode") corresponding to the thick paper is automatically set.

Here, the detection of the color deviation detection pattern will be described additionally with reference to FIG. 3. As illustrated in FIG. 3, in the detection of the color deviation detection pattern executed in the separated state, the detection patterns 42F, 42C, and 42R of the three places are formed to correct the registrations of the main scanning direction and the sub-scanning direction, the magnification of the main scanning direction, and the skew. An image formation operation is executed when the exposure device 45, the image forming device 44, and the transfer device 46A are driven according to a command from the CPU 11 of FIG. 4.

In order to accurately read a skew correction amount in particular, the skew correction amount is preferably read and calculated by the optical sensors 30F, 30C, and 30R arranged to correspond to the detection patterns 42F, 42C, and 42R in lateral end portions and a center portion of the intermediate transfer belt 21, in terms of detection precision. The calculation of the skew amount is executed by only the color deviation correction in the separated state.

The detection patterns 42F, 42C, and 42R will be described additionally. In FIG. 3, an image area G is an area in which a toner image is transferred/formed in a contact state in which the secondary transfer roller 25 is pressed to the surface of the intermediate transfer belt 21. Therefore, a width (length) of the image area G of a width direction perpendicular to a movement direction A of the intermediate transfer belt 21 is the same as a roller width L of a rotation axis direction of the secondary transfer roller 25. In addition, the lateral end portions of the intermediate transfer belt 21 are a non-image area NG in which a toner image is not transferred/formed in the contact state. In the detection patterns 42F, 42C, and 42R, four thick linear detection patterns of yellow, black, magenta, and cyan colors are formed at a predetermined interval every three places, sequentially from the upstream side to the downstream side along the movement direction A of the intermediate transfer belt 21. In detail, the detection patterns 42F, 42C, and 42R of the upstream side and the downstream side are formed in a direction parallel to the width direction and the intermediate detection patterns 42F, 42C, and 42R between the detection patterns of the upstream side and the downstream side are formed in an obliquely rightward direction.

Because colors cannot be identified in the drawings, for the four thick linear detection patterns of the individual colors, the colors are identified by changing hatching directions of the patterns, except for a black color. Specifically, the yellow-color detection pattern is shown by hatching of a horizontal direction, the black-color detection pattern is shown by blacking, the magenta-color detection pattern is shown by hatching of an obliquely leftward direction, and the cyan-color detection pattern is shown by hatching of an obliquely rightward direction opposite to the hatching direction of the magenta detection pattern.

The reason why the pattern order of yellow, black, magenta, and cyan in the detection patterns 42F, 42C, and 42R is set is as follows. That is, for the arrangement positions of the process cartridges 5Y, 5M, 5C, and 5K, yellow (Y) and magenta (M) separated from black (K) to be a reference color are positioned to be close to black (K) to minimize a read error. In the color printer 100 exemplified in this embodiment, the process cartridges 5Y, 5M, 5C, and 5K are arranged sequentially from the upstream side to the downstream side of the movement direction A of the intermediate transfer belt 21. However, arrangement order is not limited to the above arrangement order according to an apparatus type. According to the apparatus type, the process cartridges 5Y, 5C, 5M, and 5K may be arranged sequentially and the order of the detection patterns is changed by the arrangement, from the above reason.

In the conventional color deviation correction control, the predetermined printed page number interval or a thermistor temperature threshold value set on the basis of a thermistor disposed in the writing unit/exposure device in the apparatus is used as a reference of the execution timing of the color deviation correction control. The timing does not depend on the print speeds to be the plurality of image formation velocities, the constant number of printed pages is set as a threshold value, and the color deviation correction control is executed. In this case, because the normal linear-velocity mode having the highest use frequency is generally set as a reference, the color deviation correction is executed at appropriate timing, when the normal print is executed. However, when the low-velocity print is executed, a long time is taken to execute the print up to the defined number of printed pages, as compared with when the normal print is executed. As a result, a characteristic relating to image formation color matching may change temporally and temporal deterioration of color matching precision may be accelerated. A temperature characteristic of the writing unit/exposure device affecting the color matching precision greatly changes temporally. For this reason, in the present situation, a unit cooling fan is used for the writing unit to suppress a temperature rise, so that the temporal change is suppressed.

Figure 6:
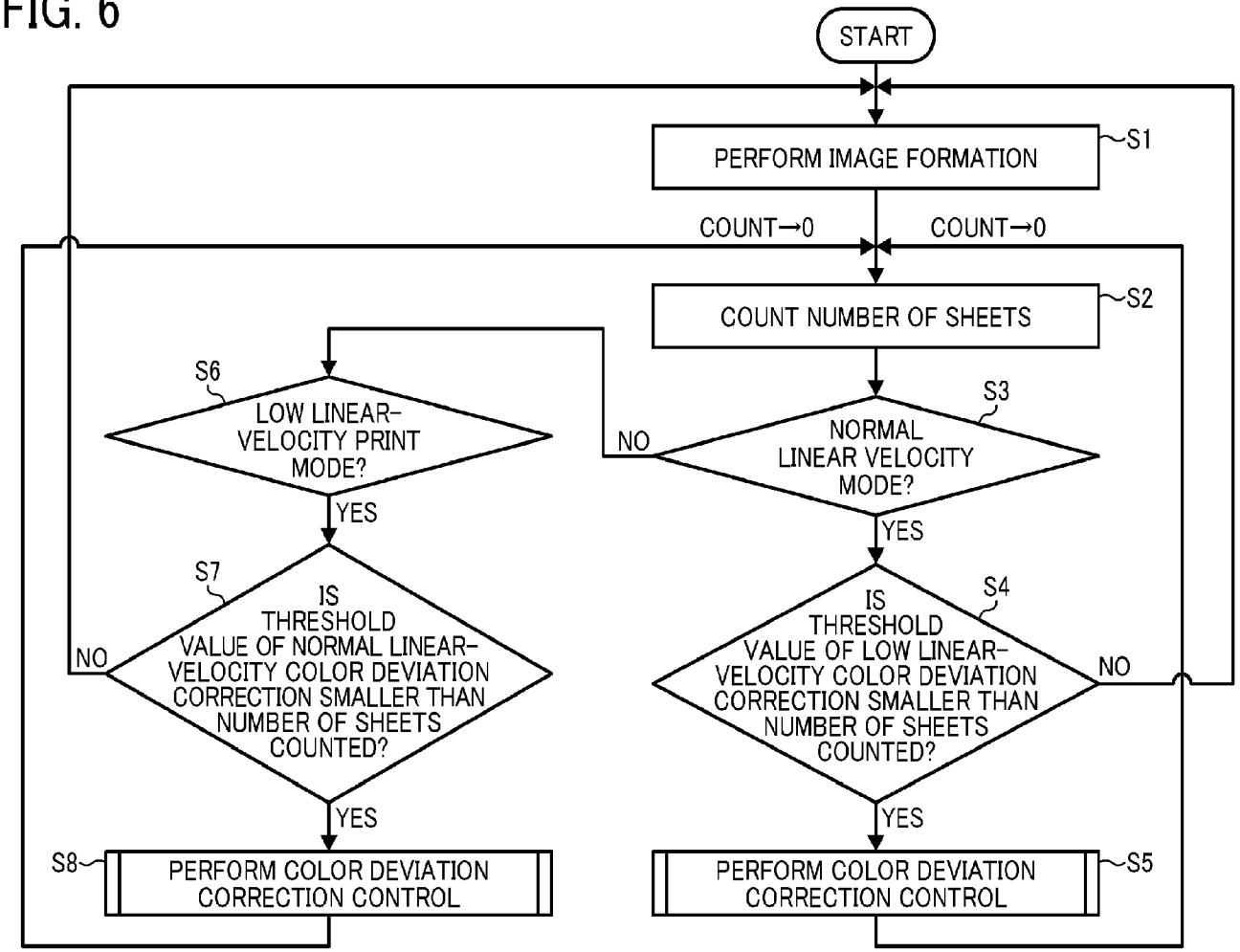
FIG. 6 is a flowchart of an operation flow relating to color deviation correction control execution timing according to the first embodiment.

Next, an operation flow according to the first embodiment will be described using FIG. 6. FIG. 6 is a flowchart of an operation flow relating to the color deviation correction control execution timing according to the first embodiment. In this embodiment, as the color deviation correction control execution timing, instead of the threshold value to which the constant number of printed pages is set in the normal linear-velocity mode in the related art, an individual correction execution page number threshold value according to each print mode is stored/set in the ROM 12. Specifically, a normal print execution counter α, a moderate-velocity print execution counter β, and a low-velocity print execution counter γ are set as the correction execution page number threshold values. At this time, a relation of the normal print execution counter α>the moderate-velocity print execution counter β>the low-velocity print execution counter γ is realized. The single printed page number counter by the CPU 11 is set and the execution page number counter is initialized/reset whenever the color deviation correction control is executed. That is, in this embodiment, the color deviation correction control execution timing when the print is executed at the normal linear velocity and the color deviation correction control execution timing when an image is formed at the low linear velocity are set independently from each other. In FIG. 6, the moderate linear-velocity mode relating to the moderate-velocity print is omitted. In addition, the low linear-velocity print mode is described as the low-velocity print mode.

In FIG. 6, first, a job starts. If an image formation operation starts, the number of printed pages supplied for the print is counted (steps S1 and S2). Next, it is determined whether the print mode is the normal linear-velocity mode (step S3). A correction execution counter page number threshold value (in FIG. 6 and the following description, described as a normal linear-velocity color deviation correction threshold value and a low linear-velocity color deviation correction threshold value) is set as a correction execution page number threshold value, according to the normal linear-velocity mode and the low-velocity print mode. Here, the threshold value is set to the normal linear-velocity color deviation correction threshold value>the low linear-velocity color deviation correction threshold value, because a temperature change in the exposure device 45 is large in the low-velocity print mode in which operating time is long, when the number of printed pages is the same.

In step S4, it is determined whether the page number count counted by the printed page number counter exceeds the normal linear-velocity color deviation correction threshold value (normal print execution counter α). When the page number count is within the normal linear-velocity color deviation correction threshold value, a determination result is No and the process returns to step S1. Meanwhile, when the page number count exceeds the normal linear-velocity color deviation correction threshold value (normal print execution counter α), the determination result is Yes, the process proceeds to step S5, and the color deviation correction control is executed. After the color deviation correction control is executed, the process returns to step S2 and the page number count is reset to "0".

Meanwhile, when it is determined in step S3 that the print mode is not the normal linear-velocity mode, in step S6, it is determined whether the low-velocity print mode is set. When the low-velocity print mode is set, it is determined whether the page number count counted by the printed page number counter exceeds the low linear-velocity color deviation correction threshold value (low-velocity print execution counter γ). When the page number count is within the low linear-velocity color deviation correction threshold value, a determination result is No and the process returns to step S1. Meanwhile, when the page number count exceeds the low linear-velocity color deviation correction threshold value (low-velocity print execution counter γ), the determination result is Yes, the process proceeds to step S7, and the color deviation correction control is executed. After the color deviation correction control is executed, the process returns to step S2 and the page number count is reset to "0". For the case of the moderate linear-velocity mode, control is executed according to the same operation content.

In the above configuration, the single printed page number counter is set. For this reason, when the print is executed in the plurality of print modes, a threshold value set as a small value, that is, a correction execution counter threshold value (counter page number threshold value) in the low-velocity print mode is preferentially used as a correction execution counter threshold value to be a correction execution page number threshold value. For example, the print in the moderate linear-velocity/low-velocity print mode is executed after the print in the normal linear-velocity mode. When the print returns to the print in the normal linear-velocity mode (normal print execution counter α), the small low linear-velocity color deviation correction threshold value (low-velocity print execution counter γ) is preferentially used. As a result, color matching precision can be avoided from being deteriorated due to the temporal change different from the temporal change in the normal linear-velocity mode during the correction.

As described above, according to the first embodiment, the correction execution page number threshold value relating to the number of sheets is individually set as the threshold value to execute the color deviation correction control according to each print mode, so that the color deviation correction control can be executed at appropriate timing in each print mode. That is, temporal color matching precision at the time of the low-velocity print can be improved. In addition, an excessive unit cooling fan operation becomes unnecessary. When a cooling unit exclusively used for the writing unit is included, the fan can be removed. For this reason, the temporal color matching precision at the time of the low-velocity print can be improved using low power and a low cost.

(First Variation)

Figure 7:
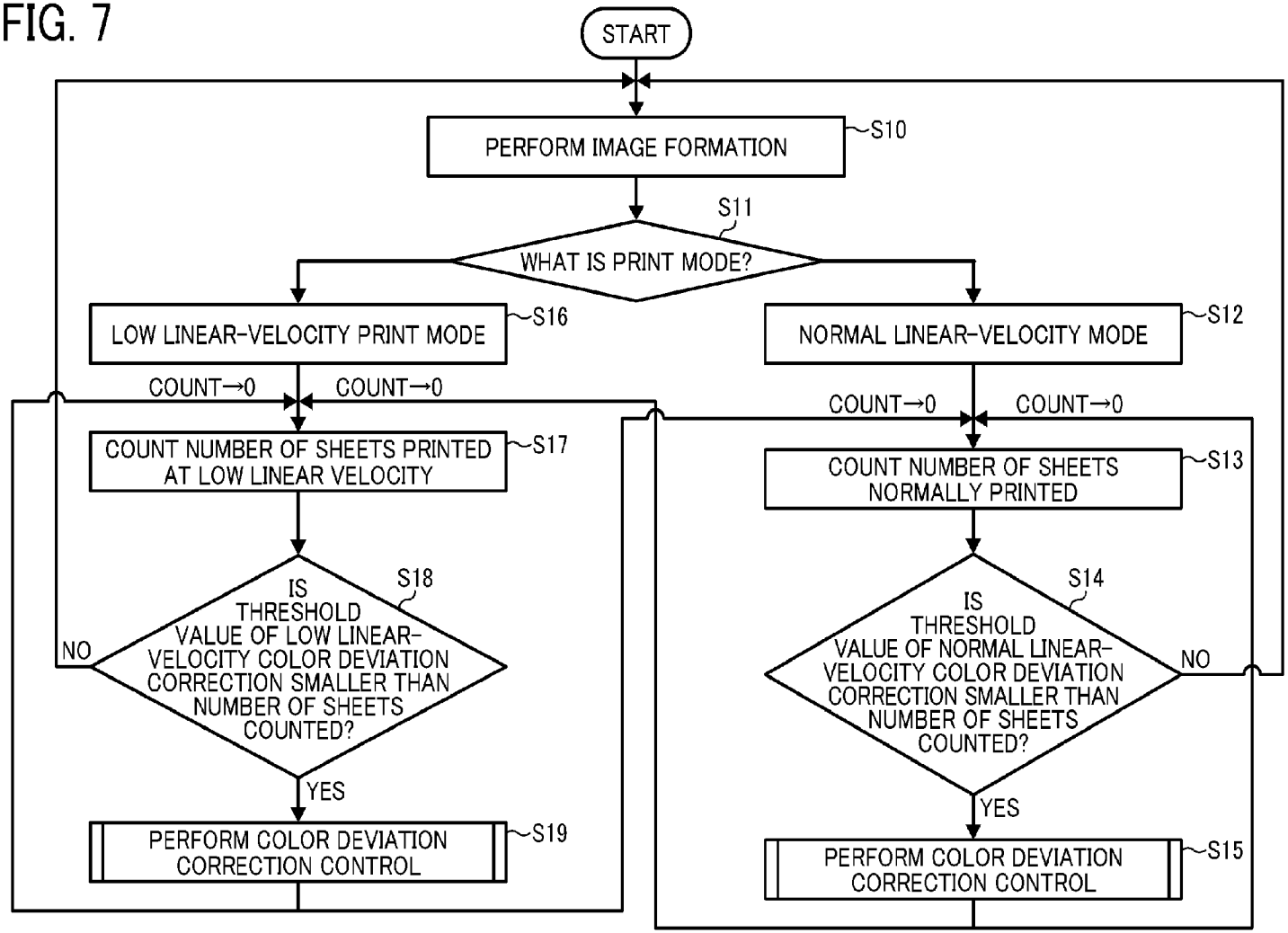
FIG. 7 is a flowchart of an operation flow relating to color deviation correction control execution timing according to a first variation.

A first variation of the first embodiment will be described using FIG. 7. FIG. 7 is a flowchart of an operation flow relating to color deviation correction control execution timing according to the first variation. In the first embodiment, a single printed page number counter is set as the printed page number counter of the CPU 11 of FIG. 4. However, in the first variation, appropriate correction timing in each print mode can be set by changing a page number monitoring configuration. As illustrated in FIG. 7, the CPU 11 has functions of a plurality of printed page number counters for each print mode and accurately counts the number of printed pages in each print mode, so that color deviation correction control can be executed at appropriate timing.

In the first variation, the CPU 11 functions as a plurality of printed page number counters corresponding to a plurality of image formation page number counters. The plurality of printed page number counters include a normal printed page number counter for a normal linear-velocity mode functioning as a normal image formation page number counter and a low-velocity printed page number counter to be a non-normal printed page number counter for a non-normal linear-velocity print mode functioning as a non-normal image formation page number counter, independent from the normal printed page number counter. As such, in this variation, a printed page number counter is set to each print mode. The CPU 11 functions as a timing controller that sets when the number of recording sheets counted by each printed page number counter set to each print mode exceeds the correction execution page number threshold value set to each print mode as color deviation correction control execution timing and executes color deviation correction control.

In FIG. 7, first, a job starts. If an image formation operation starts in step S10, a set print mode is determined (step S11). Here, when the normal linear-velocity mode is set, a normal printed page number count for the number of printed pages supplied for the print is executed by the normal printed page number counter (steps S12 and S13). Next, it is determined whether the page number count counted by the normal printed page number counter exceeds the normal linear-velocity color deviation correction threshold value (normal print execution counter α) (step S14). When the page number count is within the normal linear-velocity color deviation correction threshold value, the process returns to step S10.

Meanwhile, when the page number count exceeds the normal linear-velocity color deviation correction threshold value, the determination result is Yes, the process proceeds to step S15, and the color deviation correction control is executed. After the color deviation correction control is executed, the process returns to step S13 and the normal printed page number count is reset to "0". At the same time, the low-velocity printed page number count of step S17 is reset to "0".

Meanwhile, in steps S11 and S16, when the low-velocity print mode is set, a normal printed page number count for the number of printed pages supplied for the print is executed by the low-velocity printed page number counter (step S17). Next, it is determined whether the page number count counted by the low-velocity printed page number counter exceeds the low linear-velocity color deviation correction threshold value (low-velocity print execution counter γ) (step S18). When the low-velocity printed page number count is within the low linear-velocity color deviation correction threshold value, the process returns to step S10.

Meanwhile, when the low-velocity printed page number count exceeds the low linear-velocity color deviation correction threshold value, the process proceeds to step S19 and the color deviation correction control is executed. After the color deviation correction control is executed, the process returns to step S17 and the low-velocity printed page number count is reset to "0". At the same time, the normal printed page number count of step S13 is reset to "0".

As described above, according to this variation, in addition to the basic effect of the first embodiment, the number of printed pages in each print mode is accurately counted, so that appropriate color deviation correction control execution timing can be set, and the color deviation correction control can be executed.

Second Embodiment

Figure 8:
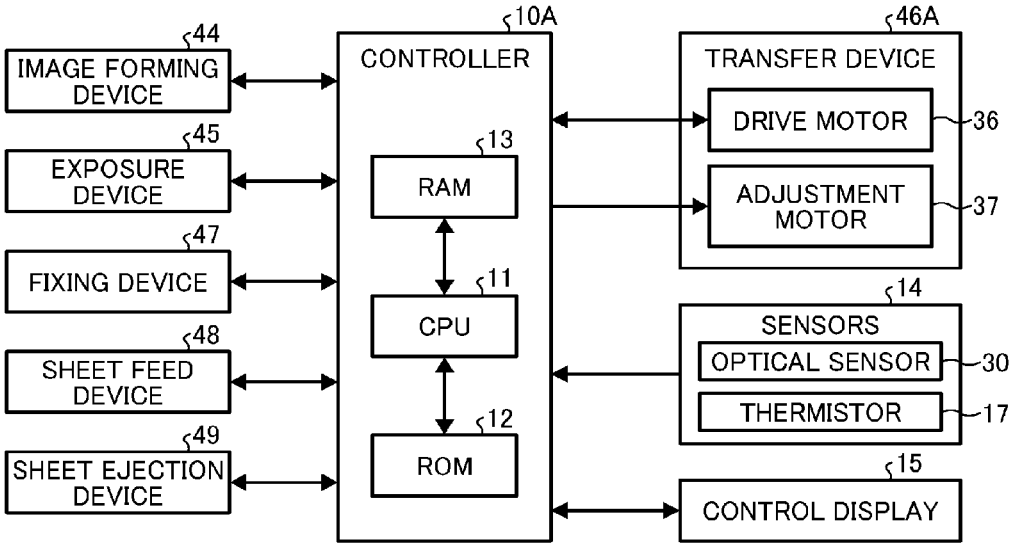
FIG. 8 is a control block diagram of a control configuration according to a second embodiment.
Figure 9:
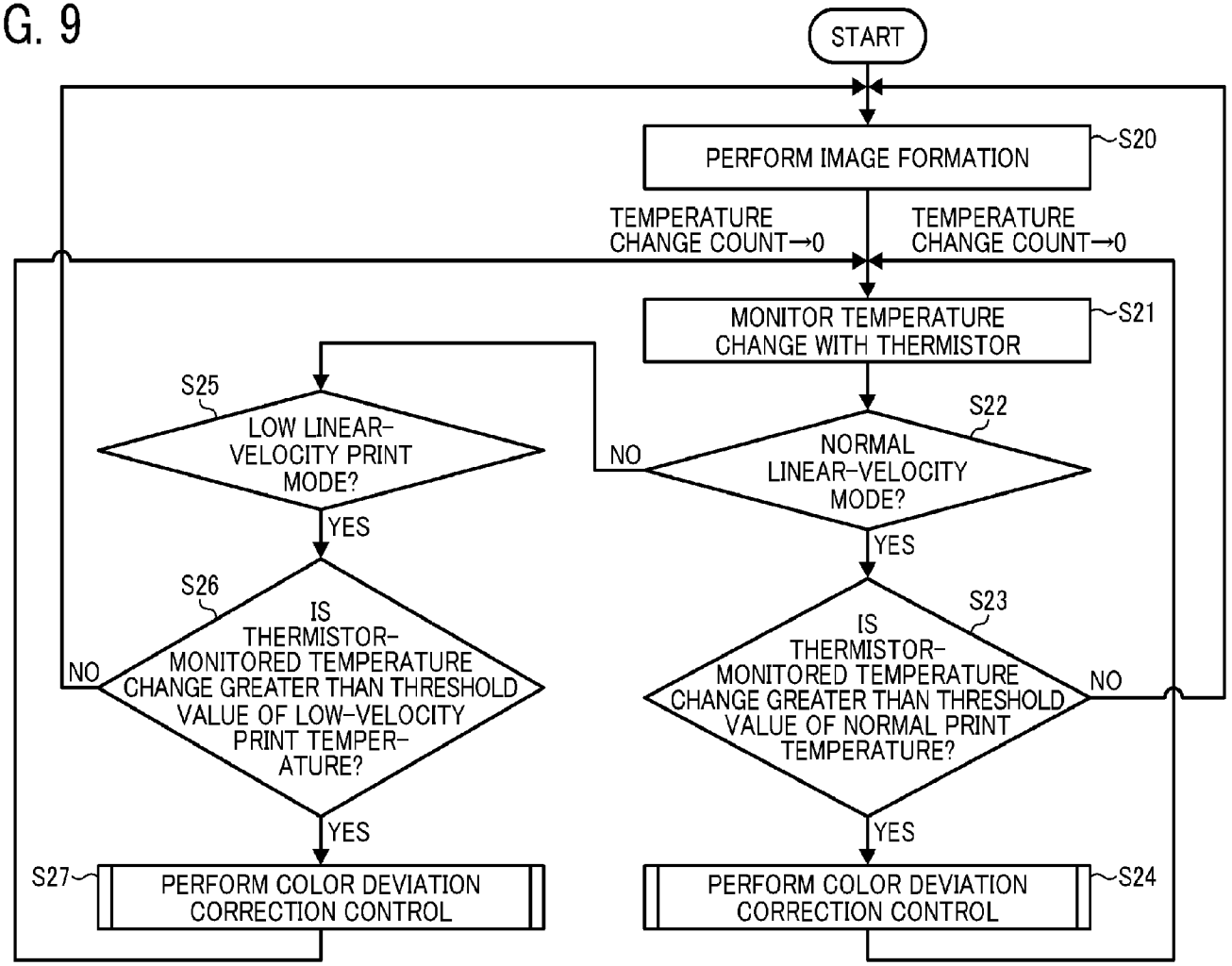
FIG. 9 is a flowchart of an operation flow relating to color deviation correction control execution timing according to the second embodiment.

A second embodiment will be described using FIGS. 8 and 9. FIG. 8 is a control block diagram of a control configuration according to the second embodiment. FIG. 9 is a flowchart of an operation flow relating to color deviation correction control execution timing according to the second embodiment. In the first embodiment and the first variation, a color deviation correction control process is executed using a printed page number count as execution timing of color deviation correction control. This is because the image formation page number relating to the elapse of time is set as an item corresponding to a temperature change due to a color deviation at the time of image formation. The temperature change due to the color deviation is mainly caused by a temperature change in the vicinity of a writing mirror in an exposure device 45. Because operating speeds of a writing motor of the exposure device 45 in a normal linear-velocity mode and a moderate linear-velocity/low-velocity print mode are different from each other, a thermistor 17 is arranged in the vicinity of the exposure device 45 and a threshold value of a temperature change difference is set to each of the normal print mode, the moderate-velocity print mode, and the low-velocity print mode. In this way, appropriate execution timing of color deviation correction control is set in the second embodiment.

A control configuration according to the second embodiment is different from the control configuration according to the first embodiment illustrated in FIG. 4 in that the thermistor 17 is used as a temperature measuring unit to measure a temperature of the exposure device 45 having a severe temperature change as a color deviation causing portion in an apparatus and a controller 10A is used, instead of a controller 10. A configuration of the second embodiment other than the difference is the same as the configuration of the first embodiment.

The controller 10A is different from the controller 10 in that a correction execution temperature threshold value relating to a temperature measured by the thermistor 17 is set as a threshold value to execute color deviation correction control, for each print mode. A ROM 12 of FIG. 8 functions as a temperature threshold setter to set the correction execution temperature threshold value. A CPU 11 of the controller 10A functions as a temperature change counter to count a temperature change detected by the thermistor 17. In addition, the CPU 11 of the controller 10A functions as a timing controller that executes color deviation correction control using when the temperature measured by the thermistor 17 exceeds the correction execution temperature threshold value set to each print mode as color deviation correction control execution timing.

In FIG. 9, first, a job starts. If an image formation operation starts, the temperature change of the exposure device 45 detected by the thermistor 17 is tracked and monitored (steps S20 and S21). Next, it is determined whether a print mode is a normal linear-velocity mode (step S22). In the case of the normal linear-velocity mode, it is determined whether the temperature (hereinafter, referred to as the "thermistor temperature change") detected by the thermistor 17 exceeds a normal print temperature threshold value corresponding to the correction execution temperature threshold value (step S23). Here, the threshold value is set to a low-velocity print temperature threshold value>a moderate-velocity print temperature threshold value>a normal print temperature threshold value, because the temperature of the exposure device 45 increases when a print speed increases, in consideration of the temperature change due to a different operating speed of a writing motor of the exposure device 45.

In step S23, when the thermistor temperature change is within the normal print temperature threshold value, a determination result is No and the process returns to step S20. Meanwhile, when the temperature detected by the thermistor 17 exceeds the normal print temperature threshold value, the determination result is Yes, the process proceeds to step S24, and the color deviation correction control is executed. After the color deviation correction control is executed, the process returns to step S21 and the temperature change count is reset to "0".

In step S25, similarly to the above, when the low-velocity print mode is set, instead of the normal linear-velocity mode, it is determined whether the thermistor temperature change exceeds the low-velocity print temperature threshold value corresponding to the correction execution temperature threshold value (step S26). When the thermistor temperature change is within the low-velocity print temperature threshold value, the process returns to step S20. Meanwhile, when the thermistor temperature change exceeds the low-velocity print temperature threshold value, the process proceeds to step S27 and the color deviation correction control is executed. After the color deviation correction control is executed, the process returns to step S21 and the temperature change count is reset to "0". For the case of the moderate linear-velocity mode, control is executed according to the same operation content.

As described above, according to this embodiment, the correction execution temperature threshold value relating to the temperature change of the exposure device 45 is individually set as the threshold value to execute the color deviation correction control according to each print mode, so that the color deviation correction control can be executed at appropriate timing in each print mode. That is, temporal color matching precision at the time of the low-velocity print can be improved. In addition, an excessive unit cooling fan operation becomes unnecessary. When a cooling unit exclusively used for the writing unit is included, the fan can be removed. For this reason, the temporal color matching precision at the time of the low-velocity print can be improved using low power and a low cost.

(Second Variation)

Figure 10:
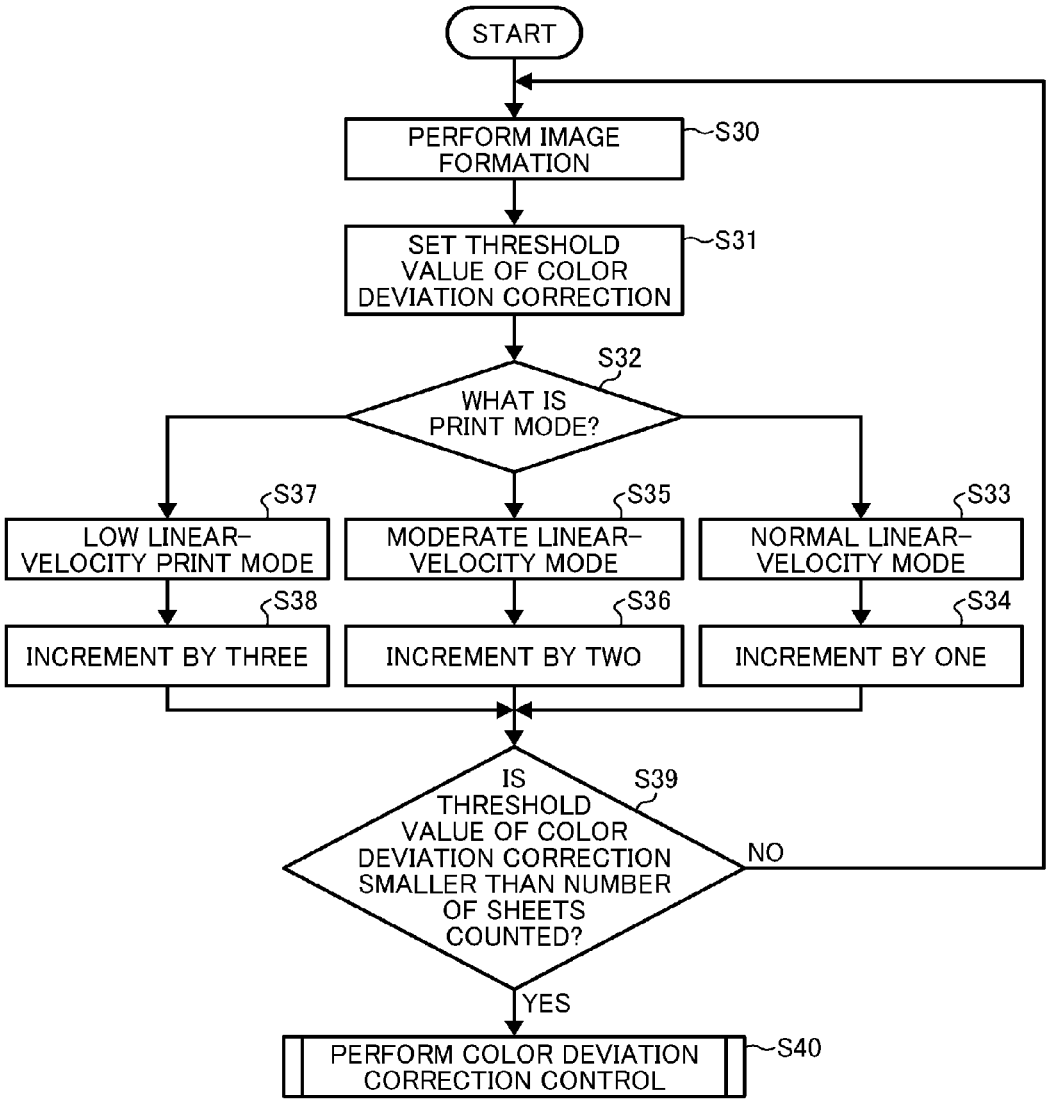
FIG. 10 is a flowchart of an operation flow relating to color deviation correction control execution timing according to a second variation.

A second variation will be described using FIG. 10. FIG. 10 is a flowchart of an operation flow relating to color deviation correction control execution timing according to the second variation. In the first variation, a plurality of printed page number counters are set. However, as measures when the plurality of printed page number counters are not set, a mechanism for setting weighting by a print mode can be configured. A single printed page number counter is used. However, a count addition amount is changed for each print mode.

For example, a count addition number at the time of printing one page is set to 1 in a normal linear-velocity mode and a count addition number at the time of printing one page is set to 2 in a moderate-velocity print mode. Likewise, a count addition number is set to 3 in a low-velocity print mode. That is, the weighting by the print mode is executed according to a degree of an influence on a color deviation. As a result, color deviation correction control is executed in a normal set page number in the normal print mode and the color deviation correction control is executed in a page number smaller than the set page number in the low-velocity print mode. However, in the second variation, the color deviation correction control can be executed at appropriate timing in the moderate-velocity/low-velocity print mode according to an apparatus state.

The second variation is different from the first variation in that an adder to add the number of recorded sheets changed for each of the normal linear-velocity mode, the moderate linear-velocity mode, and the low-velocity print mode to the number of recording sheets to be the number of sheets counted by the single printed page number counter is provided. At this time, the CPU 11 of FIG. 4 has a function as the adder. The number of recording sheets changed for each print mode is stored in the ROM 12 in consideration of a color deviation influence degree for each print mode.

In addition, the second variation is different from the first variation in that a correction execution page number threshold value relating to the number of sheets used as a threshold value to execute the color deviation correction control is not set to each print mode and is set as a single value to the ROM 12. In addition, the second variation is different from the first variation in that the moderate linear-velocity mode corresponding to a non-normal linear-velocity image formation mode is clearly displayed. The CPU 11 functions as a timing controller that sets when the number of recording sheets for each print mode added by the adder exceeds the correction execution page number threshold value as color deviation correction control execution timing and executes color deviation correction control.

Next, an operation flow according to the second variation will be described using FIG. 10. FIG. 10 is a flowchart of an operation flow relating to color deviation correction control execution timing according to the second variation. In FIG. 10, first, a job starts. If an image formation operation starts in step S30, the color deviation correction threshold value is set (step S31). Next, a set print mode is determined (step S32).

Here, in step S33, when the normal linear-velocity mode is set, the count addition number at the time of printing one page, counted by the print page number counter, is set to 1 (count up 1) and is counted (step S34).

In step S35, when the moderate linear-velocity mode is set, for the count of the number of printed pages supplied for print by the printed page number counter, the count addition number at the time of printing one page is set to 2 (count up 2) and is counted (step S36). In step S37, when the low-velocity print mode is set, the count addition number at the time of printing one page, counted by the printed page number counter, is set to 3 (count up 3) and is counted (steps S37 and S38).

Next, it is determined whether the page number count for each print mode after the count addition number is set exceeds the color deviation correction threshold value (correction execution page number threshold value) (step S39). When the page number count is within the color deviation correction threshold value, the process returns to step S30. Meanwhile, the page number count exceeds the color deviation correction threshold value, the process proceeds to step S40 and the color deviation correction control is executed.

As described above, according to this variation, in addition to the basic effect of the first embodiment, appropriate color deviation correction control execution timing for each of the normal linear-velocity mode, the moderate linear-velocity mode, and the low-velocity print mode can be set and the color deviation correction control can be executed at appropriate timing.

The embodiments of the present disclosure have been described. However, the present disclosure is not limited to the specific embodiments and various changes and modifications can be made without departing from the scope of the present disclosure, unless particularly limited in the above description. For example, the technical elements described in the embodiments of this disclosure may be appropriately combined.

An image forming apparatus to which the present disclosure is applied is not limited to the color printer of the tandem system and the present disclosure can be applied to electrophotographic image forming apparatuses such as a color copier, a fax machine, a plotter, and a multifunction peripheral including a plurality of functions. In addition, the present disclosure is not limited to the image forming apparatus of the intermediate transfer/tandem system and can be applied to an image forming apparatus of a direct transfer tandem system that superimposes a plurality of toner images on a sheet born on a conveyance belt, instead of the intermediate transfer belt functioning as the intermediate transferer, and transfers the toner images.

The effects described in the embodiments of the present disclosure are examples of effects obtained from the embodiments and the effects according to aspects of the present disclosure are not limited to the effects described in the embodiments of the present disclosure.

What is claimed is:

1. An image forming apparatus comprising:

a plurality of latent image bearers;

a latent image writer to write latent images to the latent image bearers;

a plurality of developing units to develop the latent images of the latent image bearers and form toner images of different colors;

a primary transfer unit to transfer the toner images on the latent image bearers to an intermediate transferer;

a secondary transfer unit to transfer the toner images from the intermediate transferer to a sheet;

an adjuster to cause the intermediate transferer and the secondary transfer unit to be in a contact state or a separated state;

a pattern image formation controller to form a pattern image on the intermediate transferer via the latent image bearers to detect color deviation;

a color deviation detector to detect the color deviation of the pattern image borne on the intermediate transferer;

a color deviation correction controller to execute color deviation correction control in the separated state; and an image-formation-mode setting unit to set a normal linear-velocity image formation mode in which an image is formed at a normal linear velocity and at least one non-normal linear-velocity image formation mode including a low linear-velocity image formation mode in which an image is formed at a low linear velocity slower than the normal linear velocity, wherein a plurality of image formation velocities including the normal linear velocity and the low linear velocity is set, and an execution timing of the color deviation correction control in image formation at the normal linear velocity and an execution timing of the color deviation correction control in image formation at the low linear velocity are set independently from each other.

2. The image forming apparatus according to claim 1, further comprising:

a single image formation page number counter to count a number of sheets on which images are formed; and a sheet-count threshold setter to set, for each of the normal linear-velocity image formation mode and the at least one non-normal linear-velocity image formation mode, a correction execution page number threshold value relating to the number of sheets as a threshold value to execute the color deviation correction control, wherein the execution timing of the color deviation correction control is when the number of sheets counted by the image formation page number counter exceeds the correction execution page number threshold value set for each of the normal linear-velocity image formation mode and the at least one non-normal linear-velocity image formation mode.

3. The image forming apparatus according to claim 2, wherein, when image formation for at least one sheet is executed in the low linear-velocity image formation mode after previous color deviation correction control is executed, a correction execution page number threshold value in next color deviation correction control is a threshold value set to correspond to the low linear-velocity image formation mode.

4. The image forming apparatus according to claim 2, wherein a correction execution page number threshold value set by the normal linear-velocity image formation mode is larger than a correction execution page number threshold value set by each of the moderate linear-velocity image formation mode and the low linear-velocity image formation mode.

5. The image forming apparatus according to claim 1, further comprising:

a plurality of image formation page number counters to count the number of sheets on which images are formed; and a sheet-count threshold setter to set, for each of the normal linear-velocity image formation mode and the at least one non-normal linear-velocity image formation mode, a correction execution page number threshold value relating to the number of sheets as a threshold value to execute the color deviation correction control, wherein the plurality of image formation page number counters includes a normal image formation page number counter for the normal linear-velocity image formation mode and a non-normal image formation page number counter for the at least one non-normal linear-velocity image formation mode independent from the normal image formation page number counter, and the execution timing of the color deviation correction control is when the number of sheets counted by one of the normal image formation page number counter and the non-normal image formation page number counter exceeds the correction execution page number threshold value set for each of the normal linear-velocity image formation mode and the at least one non-normal linear-velocity image formation mode.

6. The image forming apparatus according to claim 1, further comprising:

a temperature measuring unit to measure a temperature of a color deviation causing portion in the apparatus; and a temperature threshold setter to set, for each of the normal linear-velocity image formation mode and the at least one non-normal linear-velocity image formation mode, a correction execution temperature threshold value relating to the temperature measured by the temperature measuring unit as a threshold value to execute the color deviation correction control, wherein the execution timing of the color deviation correction control is when the temperature measured by the temperature measuring unit exceeds the correction execution temperature threshold value set for each of the normal linear-velocity image formation mode and the at least one non-normal linear-velocity image formation mode.

7. The image forming apparatus according to claim 1, wherein the at least one non-normal linear-velocity image formation mode includes a moderate linear-velocity image formation mode in which an image is formed at an image formation velocity slower than the normal linear velocity and faster than the low linear velocity.

8. An image forming apparatus comprising:

a plurality of latent image bearers;

a latent image writer to write latent images to the latent image bearers;

a plurality of developing units to develop the latent images of the latent image bearers and form toner images of different colors;

a primary transfer unit to transfer the toner images on the latent image bearers to an intermediate transferer;

a secondary transfer unit to transfer the toner images from the intermediate transferer to a sheet;

an adjuster to cause the intermediate transferer and the secondary transfer unit to be in a contact state or a separated state;

a pattern image formation controller to form a pattern image to detect color deviation on the latent image bearers;

a color deviation detector to detect the color deviation of the pattern image borne on the intermediate transferer;

a color deviation correction controller to execute color deviation correction control in the separated state;

an image-formation-mode setting unit to set a normal linear-velocity image formation mode in which an image is formed at a normal linear velocity, a moderate linear-velocity image formation mode in which an image is formed at a moderate linear velocity slower than the normal linear velocity, and a low linear-velocity image formation mode in which an image is formed at a low linear velocity slower than the moderate linear velocity;

a single image formation page number counter to count a number of sheets on which images are formed;

a sheet-count threshold setter to set a correction execution page number threshold value relating to the number of sheets as a threshold value to execute the color deviation correction control; and an adder to add a number of sheets changed for each of the normal linear-velocity image formation mode, the moderate linear-velocity image formation mode, and the low linear-velocity image formation mode to the number of sheets counted by the image formation page number counter, wherein a plurality of image formation velocities including the normal linear velocity, the moderate linear velocity, and the low linear velocity is set, and an execution timing of the color deviation correction control is when the number of sheets for each of the normal linear-velocity image formation mode, the moderate linear-velocity image formation mode, and the low linear-velocity image formation mode added by the adder exceeds the correction execution page number threshold value.

* * * * *